US010002500B2

(12) United States Patent
Hall et al.

(10) Patent No.: US 10,002,500 B2
(45) Date of Patent: Jun. 19, 2018

(54) EMERGENCY INFLATABLE SIGNAL LOCATOR

(71) Applicants: Michael Hall, Spirit Lake, ID (US); Kathryn Hall, Spirit Lake, ID (US)

(72) Inventors: Michael Hall, Spirit Lake, ID (US); Kathryn Hall, Spirit Lake, ID (US)

( * ) Notice: Subject to any disclaimer, the term of this patent is extended or adjusted under 35 U.S.C. 154(b) by 233 days.

(21) Appl. No.: 14/997,859

(22) Filed: Jan. 18, 2016

(65) Prior Publication Data

US 2016/0229512 A1 Aug. 11, 2016

Related U.S. Application Data

(60) Provisional application No. 62/114,687, filed on Feb. 11, 2015.

(51) Int. Cl.
*G08B 5/00* (2006.01)

(52) U.S. Cl.
CPC ..... *G08B 5/002* (2013.01)

(58) Field of Classification Search
CPC ..... G08B 5/002; A63H 27/10
USPC ..... 116/210; 446/220; 441/93, 94; D21/440
See application file for complete search history.

(56) References Cited

U.S. PATENT DOCUMENTS

| | | | | |
|---|---|---|---|---|
| 3,592,157 | A * | 7/1971 | Schwartz | F21V 3/023 116/202 |
| 5,199,374 | A | 4/1993 | Blanchette | |
| 5,262,768 | A * | 11/1993 | Florer | G08B 5/002 340/473 |
| 5,429,244 | A | 7/1995 | McCreary | |
| 5,582,127 | A | 12/1996 | Willis et al. | |
| 6,032,607 | A | 3/2000 | Ashline | |
| 6,164,239 | A | 12/2000 | Dawson | |
| 6,477,979 | B1 | 11/2002 | Sanchez | |
| 6,805,071 | B2 | 10/2004 | Jakubowski, Jr. | |
| 7,612,735 | B2 * | 11/2009 | Essig, Jr. | B01D 61/06 343/709 |
| 2003/0020667 | A1 * | 1/2003 | Essig, Jr. | E04H 15/20 343/832 |

* cited by examiner

*Primary Examiner* — Lisa Caputo
*Assistant Examiner* — Irving A Campbell
(74) *Attorney, Agent, or Firm* — Kirk A. Buhler; Buhler & Associates

(57) ABSTRACT

Improvements in an emergency inflatable signal locator is disclosed the emergency inflatable signal locator is a portable self-contained emergency inflatable illuminated signal location indicator generally provides a carrying case defining an interior volume carrying a container of compressed helium and an inflatable balloon having a reflective exterior surface and carrying a light source, the inflatable balloon connected to one end of a length of tether. The tether having a second end portion securely fastened to a reel that is securely interconnected to the interior of the carrying case allowing the inflated balloon to be retracted if necessary.

20 Claims, 4 Drawing Sheets

EMERGENCY INFLATABLE SIGNAL LOCATOR

CROSS REFERENCE TO RELATED APPLICATION

This application claims the benefit of Provisional Application Ser. No. 62/114,687 filed on Feb. 11, 2015 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a signaling device. More particularly, the present Emergency Inflatable Signal Locator in an inflatable balloon that a lost person can inflate above terrain to allow search parties to locate the lost person.

Description of Related Art Including Information Disclosed Under 37 CFR 1.97 and 1.98

Frequently, campers, boaters, hikers, mountain climbers, fishermen and other people in wilderness areas or at sea are lost or injured, or otherwise need assistance. Different types of emergency signaling location devices have been proposed, each utilizing the basic concept of providing an unfilled balloon and a container of gas, means for filling the balloon with the gas, and means for anchoring the balloon as it floats in the air.

There are various known means for signaling rescuers in emergency situations where a person requires rescuing. For example flares or smoke may be used. Alternatively, light sources such as flashlights may be used to signal others. However, these methods are typically restricted to ground level and can only be seen for limited distance, particularly if obstructions such as trees and hills block the view of these signals. Ignitable flares have also been used which are shot from a gun or the like and into the air for signaling the location of a person. Although typically rising above obstructions, such as trees and small hills, allowing those from the ground or air to see the flare, the flares illuminate the area over the person for only a very short period of time. Also, such flares can be very dangerous to use and store and can ignite fields, forests, buildings on fire.

There are a number of disadvantages to known prior art devices. Although some may be suitable for use in conjunction with a vehicle, they are generally too large and too heavy to be easily carried by a hiker, skier or hunter.

Additionally, many prior art devices use balloons that are not compatible with the use and storage of helium gas, the principal usable gas because helium has the tendency to defuse through and leak through vapor permeable materials. Further, previously known devices are characterized as having short and unreliable useful lives.

Spherical balloons as used in prior art devices are not suitable for high wind conditions because the combination of wind drag and tether vectors pushes the balloon toward the ground. Further, spheres have limited surface area for light and radar reflection.

Also, many of the prior art devices carry aloft elements other than the balloon and tether. This extra lifted weight necessitated a larger balloon and a larger gas vessel which correspondingly required a larger and heavier device.

There remains a need for a small and lightweight rescue signaling location device which can be carried on the person while hunting, hiking, and skiing or the like. It is particularly desirable that such a device have a long and reliable shelf life. It is further desirable that the device be simple and easy to use.

What is needed is an emergency inflatable illuminated signal locator device that is safe, effective to identify and signal their location for a prolonged duration so that they could be rescued. Ideally, the device would be compact, lightweight and easy to carry. The present invention fulfills these needs and provides other related advantages. The signaling device disclosed in this document provides the novel solution.

BRIEF SUMMARY OF THE INVENTION

A portable self-contained emergency inflatable signal location indicator generally provides a carrying case defining an interior volume carrying a container of compressed helium and an inflatable balloon having a reflective exterior surface and carrying a light source, the inflatable balloon connected to one end of a length of tether. The tether having a second end portion securely fastened to a reel that is securely interconnected to the interior of the carrying case allowing the inflated balloon to be retracted if necessary.

In providing such an emergency inflatable signal location indicator it is a principal object to provide a self-contained emergency inflatable signal location indicator that increases the likelihood of being located and rescued when lost.

A further object of the portable self-contained emergency inflatable signal location indicator is to provide a self-contained emergency inflatable signal location indicator that may be light weight and carried on a person.

A further object of the portable self-contained emergency inflatable signal location indicator is to provide a self-contained emergency inflatable signal location indicator that rises above the surface and is suspended at approximately eye level of aircraft in search operations.

A further object of the portable self-contained emergency inflatable signal location indicator is to provide a self-contained emergency inflatable signal location indicator having a self-contained light source.

A further object of the portable self-contained emergency inflatable signal location indicator is to provide self-contained emergency inflatable signal location indicator having a unique immediately identifiable configuration.

A further object of the portable self-contained emergency inflatable signal location indicator is to provide a self-contained emergency inflatable signal location indicator having a long shelf life.

A further object of the portable self-contained emergency inflatable signal location indicator is to provide a self-contained emergency inflatable signal location indicator having the ability to retract the balloon.

A further object of the portable self-contained emergency inflatable signal location indicator is to provide a self-contained emergency inflatable signal location indicator that is easy to use.

A further object of the portable self-contained emergency inflatable signal location indicator is to provide a self-contained emergency inflatable signal location indicator that provides a parabolic reflector on the balloon to enhance reflectivity of light waves and radar waves.

A still further object of the portable self-contained emergency inflatable signal location indicator is to provide a self-contained emergency inflatable signal location indicator that may be incorporated into a maritime life vest.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

Preferred forms, configurations, embodiments and/or diagrams relating to and helping to describe preferred aspects and versions of our invention are explained and characterized herein, often with reference to the accompanying drawings. The drawings and features shown herein also serve as part of the disclosure of our invention, whether described in text or merely by graphical disclosure alone. The drawings are briefly described below.

DETAILED DESCRIPTION OF THE INVENTION

Introductory Notes

The readers of this document should understand that dictionaries were used in the preparation of this document. Widely known and used in the preparation hereof are The American Heritage Dictionary, 4th Edition (© 2000), Webster's New International Dictionary, Unabridged, (Second Edition ©1957), Webster's Third New International Dictionary (© 1993), The Oxford English Dictionary (Second Edition, ©1989), and The New Century Dictionary (©2001-2005), all of which are hereby incorporated by this reference for interpretation of terms used herein, and for application and use of words defined in such references to more adequately or aptly describe various features, aspects and concepts shown or otherwise described herein using words having meanings applicable to such features, aspects and concepts.

This document is premised upon using one or more terms with one embodiment that may also apply to other embodiments for similar structures, functions, features and aspects of the inventions. Wording used in the claims is also descriptive of the inventions, and the text of both claims and abstract are incorporated by this reference into the description entirely.

The readers of this document should further understand that the embodiments described herein may rely on terminology and features used in any section or embodiment shown in this document and other terms readily apparent from the drawings and language common or proper therefore. This document is premised upon using one or more terms or features shown in one embodiment that may also apply to or be combined with other embodiments for similar structures, functions, features and aspects of the inventions and provide additional embodiments of the inventions.

Figure 1:
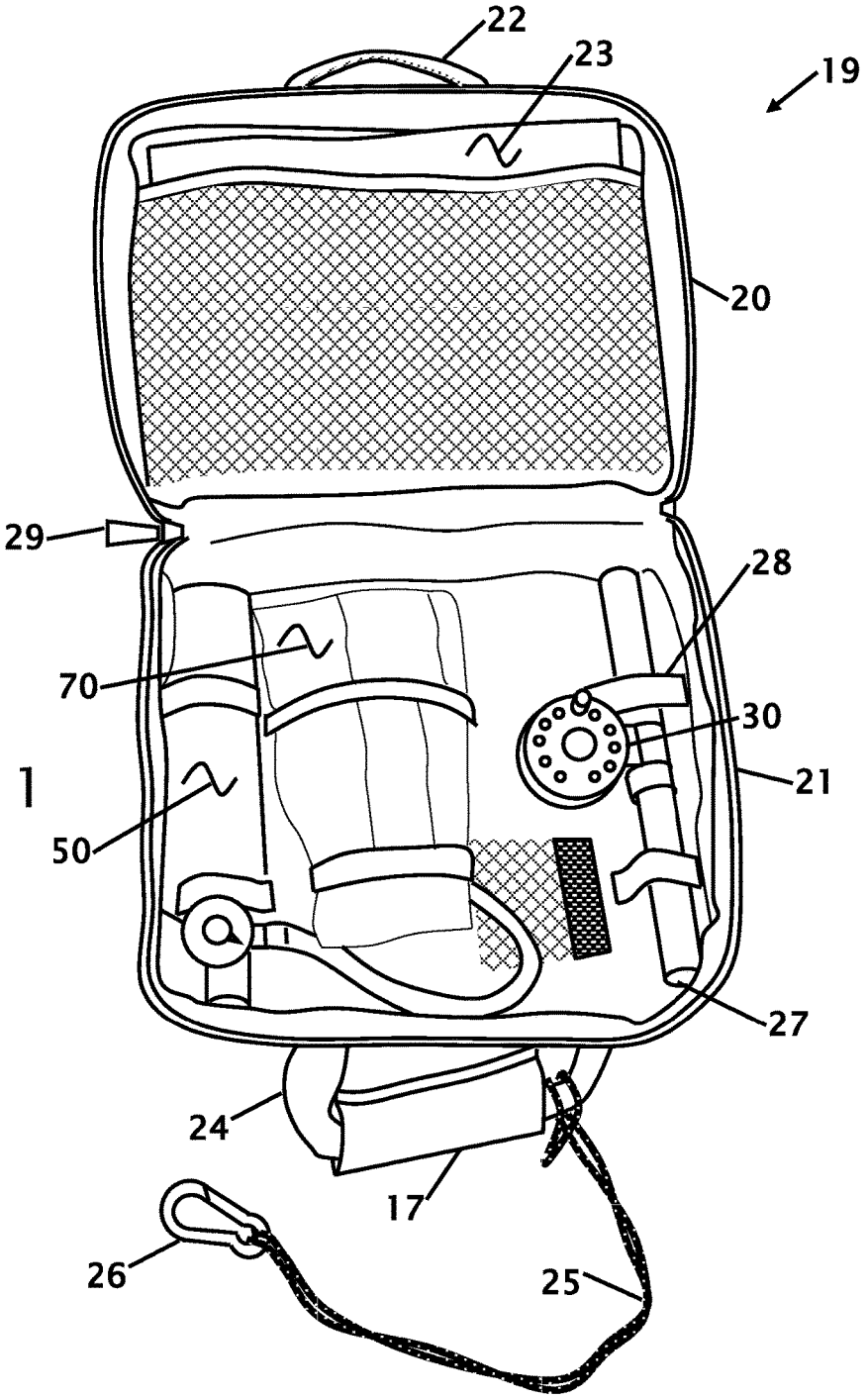
FIG. 1 is a perspective view of a case enclosing the portable self-contained emergency inflatable signal location indicator with the components within the enclosure.

FIG. 1 is a perspective view of a case 19 enclosing the portable self-contained emergency inflatable signal location indicator with the components within the enclosure. The Emergency Inflatable Signal Location Indicator generally provides a balloon 70 with a light source, a compressed gas source 50, a reel 30 and carrying a tether 25 with a closable clasp 26 are in an enclosure or case having a first side 20 and a second side 21 that encloses the components within.

In the preferred embodiment of the carrying case 19 also contains a repair kit (not shown) for repairing small tears, holes and the like that may develop in the balloon 70 which might cause a release or leaking of the lighter than air or gas. A zipper 29, hook and loop or similar mechanism encloses the carrying case 19. In this embodiment handles 22 and 24 can be used to hold or carry the case 19. Various elastic straps or straps secured with hook and loop or similar fastening system 28 hold the components with the enclosure 19. A user/owner manual 23 is included in the case in a screened area that can also be used for storage. A separate ouch 27 can be used for storage of for retaining ground spikes or fasteners that can retain the balloon/line if a user is not holding the line or reel 30.

The carrying case 19, in the preferred embodiment, is generally rectilinear having a body with a top portion 20, a spaced apart bottom portion 21, a first end portion, a second end portion, a first side portion, a second side portion and defines a medial chamber between the top portion and bottom. In the preferred embodiment, the carrying strap 17 is releasable, at least at one end portion, to provide a means for securely interconnecting the carrying case 19 to a heavy item such as a tree branch, or rock, a snowmobile, or the like to prevent inadvertent loss of the apparatus.

Figure 2:
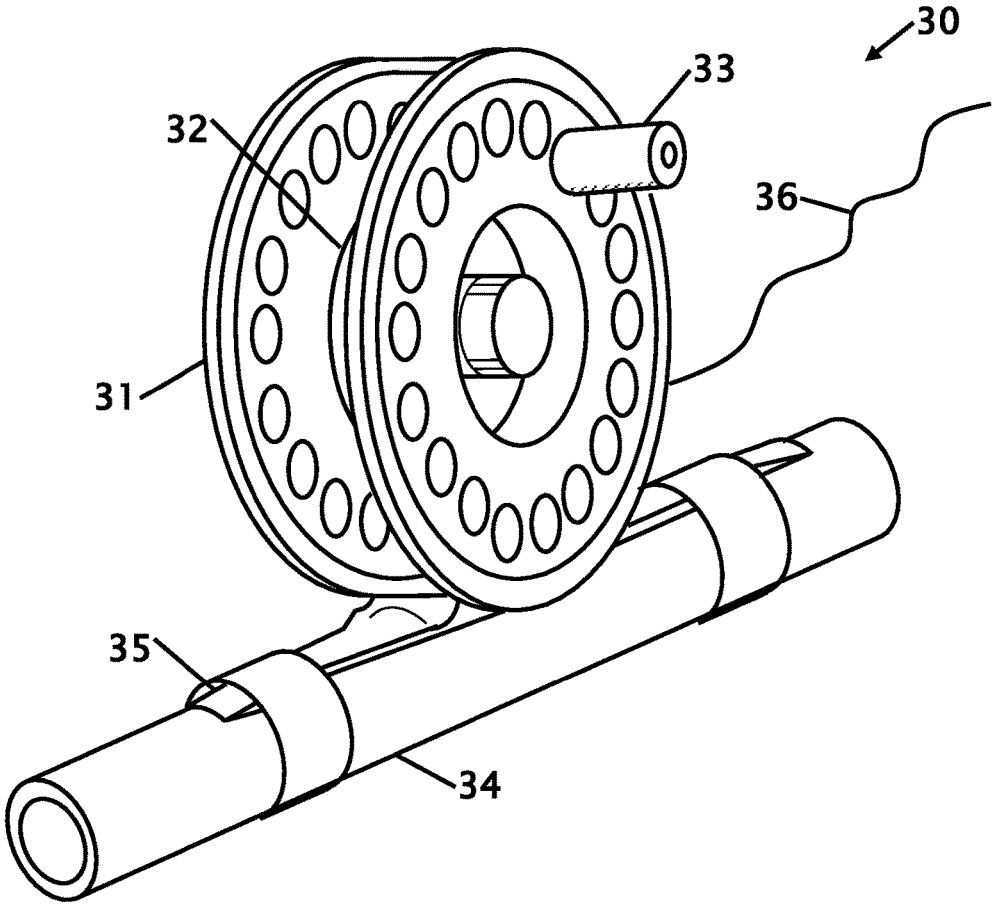
FIG. 2 is an orthographic side view of the sketch of a typical real/spool to carry the line.

FIG. 2 is an orthographic side view of the sketch of a typical real/spool to carry the line. The tether 36 is a length of strong lightweight line, such as monofilament or braided fishing line having a first end and a second end with a length. The first end 32 is securely interconnected to a swivel which is securely interconnected to the tether connector carried by the body. The swivel allows a secured balloon 70 to rotate and oscillate in even the slightest amount of wind which enhances visibility, and the swivel prevents the tether 36 from tangling. The second end is securely interconnected to the reel 30. The length is preferably approximately 600 feet to allow the balloon 70 to ascend into the air to a height approximately 500 feet above ground level allowing for horizontal displacement caused by wind and air currents and the like. The length is carried on a spool 31 carried by the reel. The spool 31 rotates on an axle interconnected with the body. A handle 34 on the spool 31 allows the spool 31 to be rotated about the axle causing the length of tether 36 to wind upon the spool 31 which permits compact efficient storage of the tether 36 when the balloon 70 is not released, and also provides a means for the balloon 70 to be retracted by a user if so needed/desired. A rotating handle 33 is used to assist in winding or unwinding the tether 36 line.

The cord 25 of the anchor 26 from the case can be passed through the center tube 34 to secure the reel 30 to prevent the reel 30 from being "pulled out of" the carrying case 19 when the balloon 70 is inflated and released and acted upon by wind and/or air currents. Weight of the reel 30 and carrying case 19 is sufficient to provide an anchor to the balloon 70 while the balloon 70 is being inflated and released. The ends 35 of the reel are configured similar to a fishing reel and can be connected or interconnected with a fishing reel or tube 34. It is contemplated that a user could use the reel for fishing.

In a second preferred embodiment, the carrying case 19 is incorporated into a life preserver vest that m y be worn by sailors and/or other persons working in the maritime industry. In the second preferred embodiment, when the carrying case 19 is incorporated into a life preserver vest, it is anticipated that the reel 30 could be removed, and the tether be connected with the balloon 70, and further be interconnected with the life preserver vest. It is further contemplated that the canister of compressed gas 50 would be flexibly connection to the vest that can be released so the canister of compressed gas 50 is not unintentionally lost or dropped.

Figure 3:
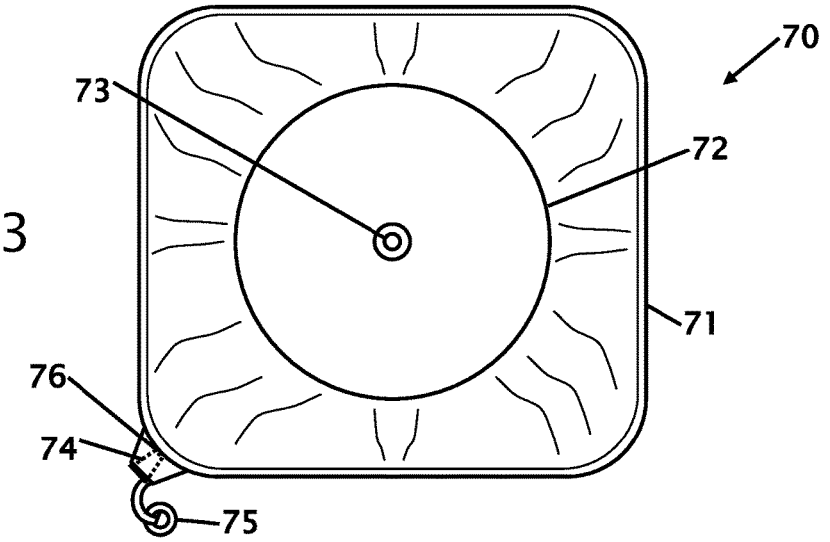
FIG. 3 is an orthographic side view sketch of the preferred configuration of balloon showing the generally rectilinear configuration defining a concave medial depression with a light source suspended at approximately the center of the concave depression to enhance reflection.

FIG. 3 is an orthographic side view sketch of the preferred configuration of balloon 70 showing the generally rectilinear configuration defining a concave medial depression with a light source suspended at approximately the center of the concave depression to enhance reflection.

The balloon 70 is formed of a lightweight flexible highly reflective material such as, but not limited to Mylar aluminized Mylar or other film coated plastic. The balloon 70 has a body 71 defining a medial chamber 72 and the body has a first side, an opposing second side, a top portion, a bottom portion. The medial chamber 72 defines a generally concave medial depression from the surrounding area. The concave medial depression 72 has a diameter and carries a flexible reflective membrane that extends across the diameter and causes the concave medial depression 72 to tend to form the shape of a parabolic reflector. In the preferred embodiment, the membrane is reflective and is preferably formed of the same material as the body 71. The body 71 defines a narrow profile on the plane extending between the first side and the second side and it defines a broad profile on the plane extending from the top portion to the bottom portion and from the first end portion to the second end portion. The concave medial depression 72 reduces the amount of lighter than air gas necessary to inflate the body 71. Further, the configuration of the body 71, with the medial depression 72 defined therein effectively forms a parabolic reflector on each side of the body 71. This parabolic reflector enhances reflection of all light waves (and radar waves) striking the body 71 which further enhances visibility of the balloon 70 from a distance in all light conditions.

A fill hole 74 with a valve 76 is preferably carried at a corner position at interconnection of the first side and bottom portion, although the fill valve hole 74 and valve 76 may be positioned at other locations on the body 71. A tether connector 75 is preferably carried at a corner position at interconnection of the second side and bottom portion to be spaced apart from the fill valve 76.

A light source 73 is interconnected to the membrane 72 at a position generally at a center of the medial depression 72. In the preferred embodiment, the light source 73 is a strobe type light emitting diode (LED) that flashes on and off in sequence and emits a visible light frequency that is highly visible, and reflects off the body 72 and the parabolic reflector. A small lightweight power source such as, but not limited to a watch battery (not shown) supplies electrical energy to the light source 73. The LEDs can flash in Morse code to flash SOS or other preprogrammed or programmable message. It is further contemplated that the LED can be multiple colors to provide contrasting colors to the color of the sky. A light or color sensor can be incorporated that determines the color of the sky and provides a color that is more noticeable. This is especially useful at sunrise or sunset where the sky can have an appearance of a red LED. It is also contemplated that a capacitor can be used as a power source or battery. A magneto pump, rotational or crank charger can be used to charge or re-charge the capacitor or the battery. This allows a person to retract the balloon and charge the battery or capacitor multiple times to extend the shelf life and the use life to signal for help. After use, the valve 76 can be operated, and the balloon squeezed to exhaust the gas from within the balloon.

Figure 4:
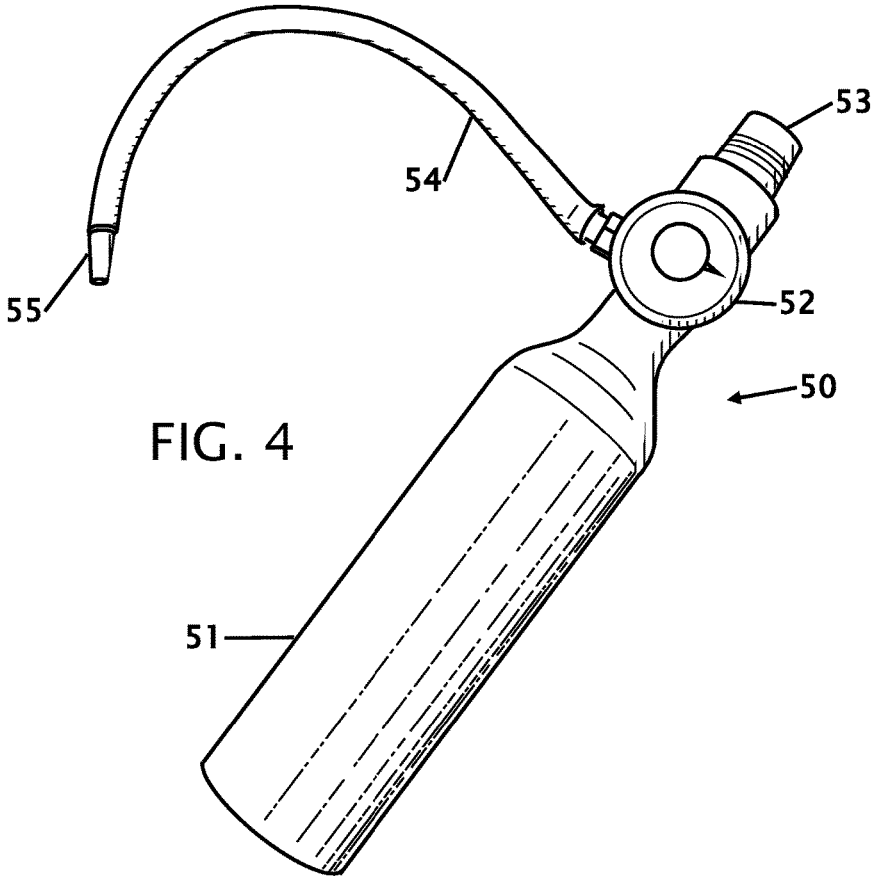
FIG. 4 is a perspective view of the gas filled cartridge.

FIG. 4 is a perspective view of the gas filled cartridge. A canister 50 of compressed gas is carried within the carrying case 19. The canister 50 of compressed gas contains an amount of pressurized lighter than air or gas, preferably helium, which is used to inflate the balloon 70. In the preferred embodiment, the amount of pressurized lighter than air gas within the canister 51 of compressed gas is sufficient to inflate the balloon 70 more than once. A pressure gauge 52 may be connected between the pressurized gas canister. 51 and the nozzle 55. The pressure gauge 52 can indicate pressure or the number of filling cycles for the balloon 70.

In a second preferred embodiment, a second canister of compressed gas 50 may be carried within the carrying case 19 for safety redundancy. Each canister of compressed gas 50 has a generally cylindrical/tubular body 51 that defines a medial chamber (not shown) and contains a manually operable valve/nozzle 75 which allows a user to disburse/release the compressed lighter than air or gas from the canister 51 of compressed gas into the balloon 70 body. In a preferred embodiment, each canister of compressed gas 50 has a seal a user can manipulate and that it is easy to disrupt/break, but is also sufficiently stable to prevent unintended and accidental rupture of the seal. In the preferred embodiment, a manually operated valve 53 is user operable to open and close the flow of gas through hose 54, nozzle 55 and into the balloon 70.

Figure 5:
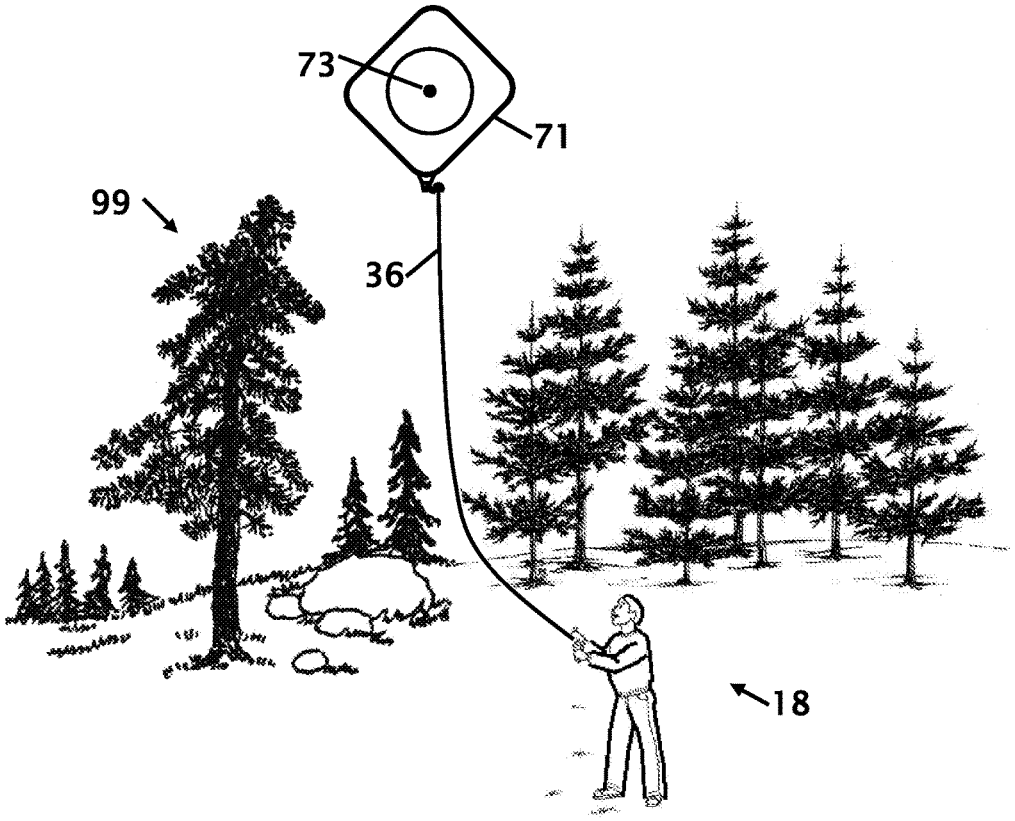
FIG. 5 shows the portable self-contained emergency inflatable signal location indicator in use.

FIG. 5 shows the portable self-contained emergency inflatable signal location indicator in use. Having described the structure of our emergency inflatable signal location indicator its use is described. A user (not shown) such as a snowmobiler who has suffered an injury, or mechanical breakdown and is in need of assistance and/or rescue, would remove the carrying case 19 from its location on the snowmobile, such as in a storage compartment or cargo bag. The balloon 70 would be unfurled and the nozzle 55 of the container of compressed gas 50 is interconnected with the fill valve 74 carried by the balloon 70. The nozzle 55 is actuated allowing the compressed lighter than air gas to exit the container of compressed gas 50 and enter the medial chamber 71 defined by the body of the balloon 70. When the balloon 70 is completely (or sufficiently inflated, the fill valve 53 is closed sealing the lighter than air gas (helium) within the medial chamber 72.

The user 18 would then actuate an on/off switch on the light source 73 on the balloon 70 ensuring that the light sources 73 begin strobe cycles of flashing light which reflect off the balloon 70, the membrane 72 and the parabolic reflector. The balloon 70 is released and the spool 31 of the reel 30 is allowed to rotate allowing the length of the tether 36 to extend from the reel 30 which responsively allows the balloon 70 to ascend. In the preferred embodiment, the balloon 70 is allowed to ascend to a height of approximately 500 feet to 600 feet which places the balloon 70 at approximately the height of aircraft engaged in search and rescue operations. The reflectivity of the balloon 70 and the light source 73 within the parabolic reflector formed by the concave medial depressions 72 enhances the visibility of the flashing strobe light and increases the likelihood that the user will be located by search and rescue personnel. If, circumstances warrant, such as the balloon 70 becoming entangled in trees and the like, the reel 30 may be used to retract the balloon 70 and also to simultaneously wind the tether 36 in an organized fashion upon the spool 31 so that the balloon 70 may be released again in a more clear area. In addition, if weather conditions, such as high winds are present, it may be necessary to retract the balloon 70 for a deployment at a later time. The height at which the balloon 70 may be deployed 500 to 600 feet above the ground surface is also typically sufficient to place the balloon 70 above ground fog and above small hills, ridges and the like to enhance the likelihood of location and rescue.

The emergency inflatable signal locator device comprises a self-contained emergency inflatable illuminated signaling location device. The device generally comprises a carrying case containing a reel carrying a length of tether, canister containing lighter than air gas, such as helium having a nozzle for dispensing the gas from the canister into an inflatable balloon connected to the tether. The inflatable balloon has a fill valve that connects to a nozzle for introducing the gas into the balloon and preventing escape of the gas from the balloon. A light source carried on each side of the balloon comprises of a battery to illuminate one or more light emitting diodes (LED). The elements of the emergency kit are contained within a small and light weight carrying case. In the event of an emergency, it is envisioned the light source would automatically be activated when the balloon is inflated. The reel, carrying a length of the tether is interconnected to the balloon and to the carrying case. The reel allows a user to extend the balloon, and also to retract the balloon when necessary, such as if the balloon were to become "tangled" in trees, or in extreme weather conditions. The reel 30 and its attached line would be securely fastened to the carrying container body such that the balloon would not be lost.

In a further preferred embodiment, the balloon as a unique configuration, preferably that of an orthogonal body defining on each side a concave medial depression that forms a parabolic reflector. The balloon is preferably formed of a highly reflective material, such as a foil laminated plastic that is reflective and is impermeable to helium gas molecules. The LED light source is preferably attached within the medial depression defined in each side of the balloon. The reflective nature of the material comprising the balloon enhances the reflectivity and the parabolic shape of the medial depression even further enhances the reflectivity of light waves and radar waves to increase the likelihood the balloon will be seen by rescuers.

In the preferred embodiment of the reel/spool contains approximately 600 feet of line. This approximately 600 feet of line is critical because in search and rescue operations, search and rescue aircraft typically operated at an altitude of approximately 500 feet above ground surface. Extending the balloon to approximately 500 feet above the ground position where the LED(s) with the balloon generated reflections at the same elevation as pilots and aircraft performing search operations.

Further, extending the balloon a distance of approximately 500 feet above ground level (water level) causes the balloon to be visible over the horizon from aircraft performing search operations and thus dramatically increases a likelihood of location of a person in the water. Further still, the 500 foot length extends the balloon well above the height of even the tallest trees 99, and above the summits of small hills and ridges and out of ravines to enhance the likelihood of location and rescue in emergency situations.

Various portions and components of apparatus within the scope of the inventions, including for example, structural components, can be formed by one or more various suitable manufacturing processes known to those in the art of signal devices and lighter than air devices. Similarly, various portions and components of apparatus within the scope of the inventions can be made from suitable materials known to those in the art of signal devices and lighter than air devices.

The above description has set out various features, functions, methods and other aspects of our invention. This has been done with regard to the currently preferred embodiments thereof. Time and further development may change the manner in which the various aspects are implemented.

The scope of protection accorded the inventions as defined by the claims is not intended to be limited to the specific sizes, shapes, features or other aspects of the currently preferred embodiments shown and described. The claimed inventions may be implemented or embodied in other forms while still being within the concepts shown, described and claimed herein. Also included are equivalents of the inventions which can be made without departing from the scope of concepts properly protected hereby having thusly described and disclosed our emergency inflatable signal location indicator, we file this Provisional patent application.

Thus, specific embodiments of an emergency inflatable signal locator have been disclosed. It should be apparent, however, to those skilled in the art that many more modifications besides those described are possible without departing from the inventive concepts herein. The inventive subject matter, therefore, is not to be restricted except in the spirit of the appended claims.

SEQUENCE LISTING

Not Applicable.

The invention claimed is:

1. An emergency inflatable signal location indicator comprising:

an inflatable reflective body defining a medial chamber for containment of lighter than air gas having a first side and a second side, each side defining a concave medial depression with a flexible reflective membrane extending across the medial depression;

a light source carried on each side of the inflatable body somewhere on the surface of said concave medial depression which generates light pulses that reflect off the inflatable reflective body;

a tether interconnected with the inflatable reflective body and interconnected with a reel configured to wind the tether about the reel;

a canister of compressed lighter than air gas having a user operable valve to allow the compressed lighter than air gas to be injected into the medial chamber of the inflatable reflective body, and a carrying case defining a medial chamber for carriage of the deflated reflective body, the light source, the tether, the reel and the canister of compressed lighter than air gas.

2. The emergency inflatable signal location indicator according to claim 1, wherein said inflatable reflective body is aluminized Mylar.

3. The emergency inflatable signal location indicator according to claim 1, wherein said inflatable reflective body is film coated plastic.

4. The emergency inflatable signal location indicator according to claim 1, wherein said light source is a light emitting diode (LED).

5. The emergency inflatable signal location indicator according to claim 4, wherein said light emitting diode is a multi-colored light emitting diode.

6. The emergency inflatable signal location indicator according to claim 1, further includes a power supply.

7. The emergency inflatable signal location indicator according to claim 1, wherein said power supply is a battery.

8. The emergency inflatable signal location indicator according to claim 1, wherein said power supply is a capacitor.

9. The emergency inflatable signal location indicator according to claim 1, that further includes a magneto charging unit.

10. The emergency inflatable signal location indicator according to claim 1, wherein said light source flashes.

11. The emergency inflatable signal location indicator according to claim 10, wherein said flashing source flashes a programmed signal.

12. The emergency inflatable signal location indicator according to claim 10, wherein said light source flashes a Morse code signal.

13. The emergency inflatable signal location indicator according to claim 12, wherein said Morse code signal is SOS.

14. The emergency inflatable signal location indicator according to claim 1, wherein said compressed gas is helium.

15. The emergency inflatable signal location indicator according to claim 1, wherein said tether is monofilament or braided fishing line.

16. The emergency inflatable signal location indicator according to claim 1, wherein said reel is connected to an interior of the carrying case.

17. The emergency inflatable signal location indicator according to claim 1, further includes a pressure gauge.

18. The emergency inflatable signal location indicator according to claim 17, wherein said pressure gauge indicates pressure and/or a number of filling cycles remaining in the canister of compressed lighter than air gas.

19. The emergency inflatable signal location indicator according to claim 1, wherein said light source is interconnected to the membrane at a position generally at a center of the medial depression.

20. The emergency inflatable signal location indicator according to claim 1, wherein said tether has a length that allows said inflatable reflective body to be visible in the sky.

* * * * *